US010441031B2

(12) United States Patent
Smaniotto

(10) Patent No.: US 10,441,031 B2
(45) Date of Patent: Oct. 15, 2019

(54) CUSTOMIZABLE FOOTWEAR INSERTS AND METHODS FOR USING SAME

(71) Applicant: Saluber S.r.l., Vicenza (IT)

(72) Inventor: Ferruccio Smaniotto, Vicenza (IT)

(73) Assignee: Saluber S.R.L., Vicenza (IT)

( * ) Notice: Subject to any disclaimer, the term of this patent is extended or adjusted under 35 U.S.C. 154(b) by 279 days.

(21) Appl. No.: 14/886,007

(22) Filed: Oct. 17, 2015

(65) Prior Publication Data

US 2017/0105482 A1 Apr. 20, 2017

(51) Int. Cl.

| | |
|---|---|
| ***A43B 17/00*** | (2006.01) |
| ***A43B 17/18*** | (2006.01) |
| ***A43B 7/14*** | (2006.01) |
| ***A43B 7/28*** | (2006.01) |

(52) U.S. Cl.

CPC ..... *A43B 17/006* (2013.01); *A43B 7/1405* (2013.01); *A43B 7/1465* (2013.01); *A43B 7/28* (2013.01); *A43B 17/00* (2013.01); *A43B 17/003* (2013.01); *A43B 17/18* (2013.01)

(58) Field of Classification Search

CPC ..... A43B 7/28; A43B 7/1405; A43B 7/1465; A43B 13/40; A43B 13/186; A43B 13/386; A43B 17/00; A43B 17/003; A43B 17/14; A43B 17/18

USPC ..... 36/44

See application file for complete search history.

(56) References Cited

U.S. PATENT DOCUMENTS

| | | | | |
|---|---|---|---|---|
| 4,151,660 | A | 5/1979 | Itoh | |
| 4,237,626 | A * | 12/1980 | Brown | A43B 7/28 12/146 B |
| 5,154,682 | A * | 10/1992 | Kellerman | A43B 1/0072 36/178 |
| 5,329,705 | A | 7/1994 | Grim et al. | |
| 5,768,803 | A | 6/1998 | Levy | |

(Continued)

FOREIGN PATENT DOCUMENTS

| | | | |
|---|---|---|---|
| GB | 2451739 | A | 2/2009 |
| WO | 2004021817 | A1 | 3/2004 |

(Continued)

OTHER PUBLICATIONS

International Search Report dated Dec. 21, 2016 for International Application No. PCT/IB2016/001385, filed Sep. 6, 2016, 6 pgs.

(Continued)

*Primary Examiner* — Anne M Kozak
(74) *Attorney, Agent, or Firm* — Brooks Kushman P.C.

(57) ABSTRACT

Systems and methods for customizable footwear inserts having a plurality of removable sections. Removable sections may be permanently bonded to adjacent layers of the inserts to eliminate or minimize the tendency of removable sections surrounding the removed sections to fall out or migrate into the cavity created by the removed sections. In some aspects, multiple layers are provided to increase the comfort, support, and/or fit provided to the wearer of the insert. Further, some embodiments include a removable backing that, when removed, exposes an adhesive that may be utilized to, inter alia, adhere an original insole of footwear to the top of the footwear insert such that the user's foot is still in contact with the original insole when wearing the footwear.

8 Claims, 6 Drawing Sheets

(56) References Cited

U.S. PATENT DOCUMENTS

| | | | | |
|---|---|---|---|---|
| 6,195,917 | B1 | 3/2001 | Dieckhaus | |
| 6,205,685 | B1 * | 3/2001 | Kellerman | A43B 1/0072 36/160 |
| 6,675,501 | B2 * | 1/2004 | Pfander | A43B 7/144 36/141 |
| 6,792,699 | B2 * | 9/2004 | Long | A43B 1/0009 36/154 |
| 7,210,250 | B2 * | 5/2007 | Gallegos | A43B 1/0054 36/140 |
| 8,978,275 | B2 * | 3/2015 | James | A43B 1/0027 36/103 |
| 9,125,454 | B2 * | 9/2015 | De Roode | A43B 7/144 |
| 2004/0045195 | A1 | 3/2004 | Long et al. | |
| 2005/0150133 | A1 | 7/2005 | Khoury | |
| 2007/0282562 | A1 | 12/2007 | Schwartz et al. | |
| 2012/0023776 | A1 | 2/2012 | Skaja et al. | |
| 2013/0067769 | A1 * | 3/2013 | Hamel | A43B 3/0047 36/98 |
| 2014/0059885 | A1 * | 3/2014 | Patchett | A43B 7/142 36/44 |
| 2015/0075030 | A1 | 3/2015 | Walborn et al. | |

FOREIGN PATENT DOCUMENTS

| | | | |
|---|---|---|---|
| WO | 2006035469 | A2 | 4/2006 |
| WO | 2010104824 | A1 | 9/2010 |

OTHER PUBLICATIONS

Written Opinion of the Intornationial Searching Authority dated Dec. 21, 2016 for International Application No. PCT/IB2016/001385, filed Sep. 6, 2016, 9 pgs.

International Preliminary Report on Patentability dated Apr. 17, 2018 for International Application No. PCT/ IB2016/001365, filed Sep. 6, 2016, 10 pgs.

* cited by examiner

CUSTOMIZABLE FOOTWEAR INSERTS AND METHODS FOR USING SAME

BACKGROUND OF THE INVENTION

Embodiments of the present invention generally relate to systems and methods for customizable footwear inserts. More specifically, the present invention relates to systems and methods for customizable footwear inserts having a plurality of removable sections.

Shoe insoles or inserts are commercially available devices that may be used to increase the comfort of various types of footwear. Some such insoles may also be designed to relieve painful conditions, such as bunions, hammer-toes, nerve pain or other painful conditions of the foot. Insoles, sold over-the-counter, are relatively inexpensive but can provide limited relief of many conditions since they are not customizable. Doctor prescribed, custom-designed orthotics can provide relief, but are expensive, inconvenient to replace and are typically relatively non-adjustable. As such, there is a need for insoles that are inexpensive, widely-available, easily adjustable and provide pain relief for a wide range of painful and/or damaging foot conditions

BRIEF SUMMARY OF THE INVENTION

In one embodiment of the invention, a footwear insert is provided. The footwear insert comprises a first layer having an upwardly facing surface and a downwardly facing surface, at least one removable section, the removable section having an upwardly facing surface coupled to the first layer downwardly facing surface via a permanent bond.

In another embodiment of the invention, the footwear insert is comprised of: a first layer having an upwardly facing surface and a downwardly facing surface; a second layer having an upwardly facing surface and a downwardly facing surface, the second layer upwardly facing surface is coupled to the first layer downwardly facing surface via a first bond; and a third layer having an upwardly facing surface and a downwardly facing surface, the third layer upwardly facing surface is coupled to the second layer downwardly facing surface via a second bond; and at least one removable section having an upwardly facing surface coupled to the third layer downwardly facing surface via a third bond.

In another embodiment of the invention the footwear insert comprises: a first layer having an upwardly facing surface and a downwardly facing surface; a second layer having an upwardly facing surface and a downwardly facing surface, the second layer upwardly facing surface coupled to the first layer downwardly facing surface via a first bond; a third layer having an upwardly facing surface and a downwardly facing surface, the third layer upwardly facing surface coupled to the second layer downwardly facing surface via a second bond; a fourth layer having an upwardly facing surface and a downwardly facing surface, the fourth layer upwardly facing surface coupled to the third layer downwardly facing surface via a third bond; and at least one removable section having an upwardly facing surface coupled to the fourth layer downwardly facing surface via a fourth bond.

In yet another embodiment, a method of using a footwear insert comprises the steps of: creating a customized footwear insert by tearing at least one removable section of the footwear insert to remove a substantial portion of the removable section from the footwear insert, wherein the footwear insert includes a first layer having an upwardly facing surface and a downwardly facing surface, and at least one removable section, the removable section upwardly facing surface coupled to the first layer downwardly facing surface via a permanent bond; and the customized footwear insert is insert into footwear.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
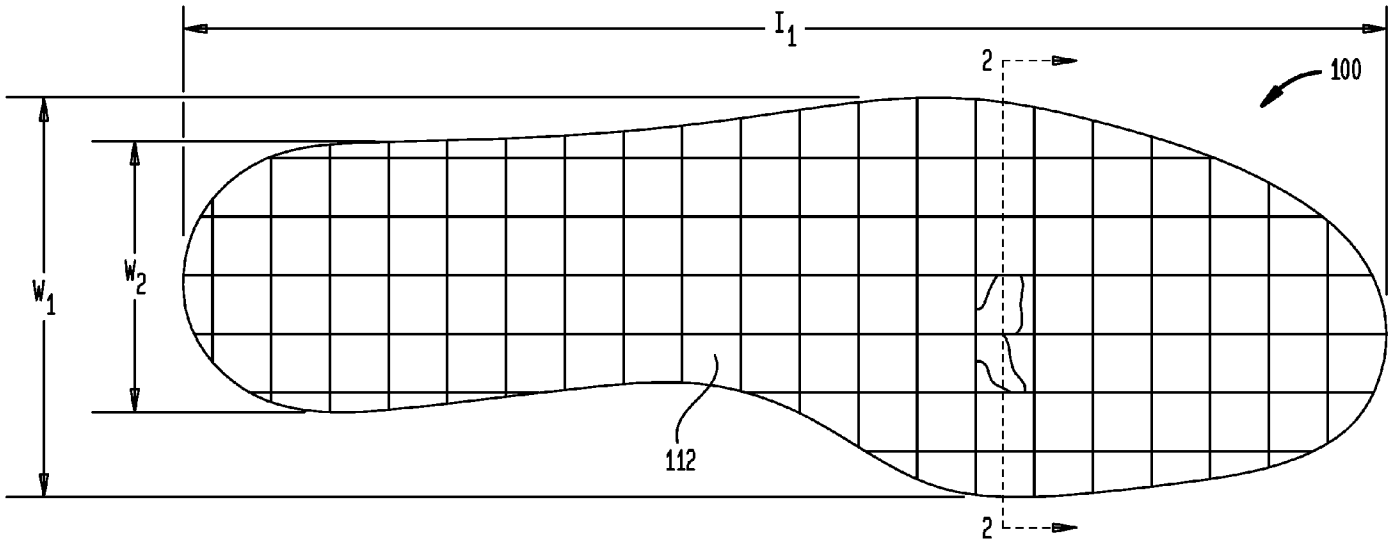
FIG. 1 is a bottom view of a footwear insert shaped in the form of a standard footwear insole in accordance with one embodiment of the present invention.

Certain terminology may be used in the following description for convenience only and is not limiting. The words "lower" and "upper" and "top" and "bottom" designate directions in the drawings to which reference is made. The terminology includes the words above specifically mentioned, derivatives thereof and words of similar import.

Furthermore, the subject application references certain processes which are presented as series of ordered steps. It should be understood that the steps described with respect to those processes are not to be understood as enumerated consecutive lists but could be performed in various orders while still embodying the invention described herein.

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "a layer" may include a plurality of layers. Thus, for example, a reference to "a method" includes one or more methods, and/or steps of the type described herein and/or which will become apparent to those persons skilled in the art upon reading this disclosure.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods, constructs and materials are now described. All publications mentioned herein are incorporated herein by reference in their entirety. Where there are discrepancies in terms and definitions used in references that are incorporated by reference, the terms used in this application shall have the definitions given herein.

Disclosed herein are systems and methods for creating and using customizable footwear inserts. Such inserts may be worn in various types of footwear including, without limitation, standard and specialty shoes, boots, orthopedic braces and apparatus, and postoperative shoes. The customizable footwear inserts may be customized by the user to shift force (when one is walking or standing) away from targeted areas of the feet that may be painful, injured or otherwise damaged, to other targeted areas of the foot. This may sometimes be referred to as "off-loading." In some aspects of the present invention, the footwear insert allows the creation of one or more "offloading zone(s)" to minimize the forces and pressure experienced by targeted areas of the feet during walking and standing (e.g., to protect injuries from force and stress, and to reduce pain).

Referring to FIG. 1, depicted is a bottom view of a footwear insert 100 shaped in the form of a standard footwear insole in accordance with one embodiment of the present invention. An insert sized in this manner may be used with zero, or minimal, trimming of the exterior edges of the insert (i.e., the insert may simply be slid into the shoe as is). In the depicted embodiment, the insert has a length I1 of approximately 10.25 inches and widths W1 and W2 of approximately 3.5 and 2.5 inches, respectively, however, alternate dimensions may be substituted without departing from the scope hereof.

Figure 2:
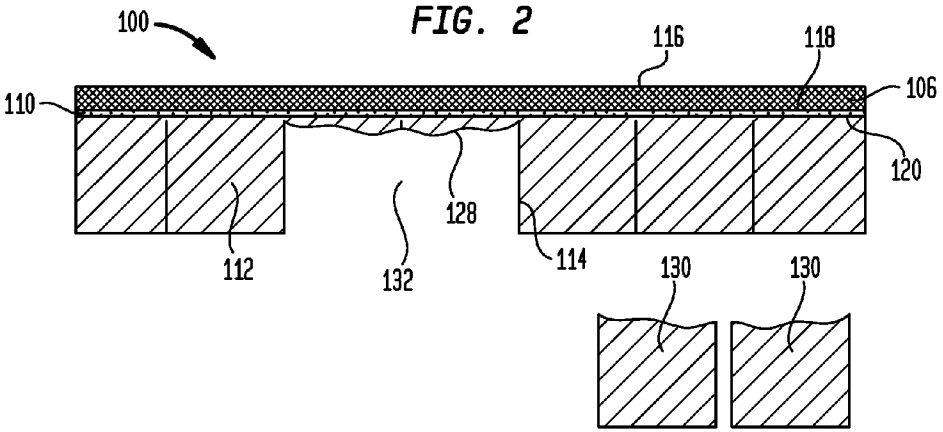
FIG. 2 is a cross-sectional view of the footwear insert depicted in FIG. 1 taken along lines 2-2 of FIG. 1.

As may be best seen in the cross-sectional view of FIG. 2, insert 100 includes a first layer 106 having a first layer upwardly facing surface 116 and a first layer downwardly facing surface 118 and a plurality of removable sections 112. Removable section upwardly facing surfaces 120 are coupled to first layer downwardly facing surface 118 via a bond 110.

In the depicted embodiment, first layer 106 is microfiber, specifically Alcantara®, which has a blend of approximately 68% polyester and approximately 32% polyurethane. First layer 106 has an approximate thickness of one (1) millimeter ("mm"), however alternate thicknesses may be substituted without departing from the scope hereof. Alternate materials may be substituted without departing from the scope of the present invention including, without limitation, a single or double-sided adhesive material (i.e., a flat material that has adhesive applied on both of its major surfaces).

Figure 5:
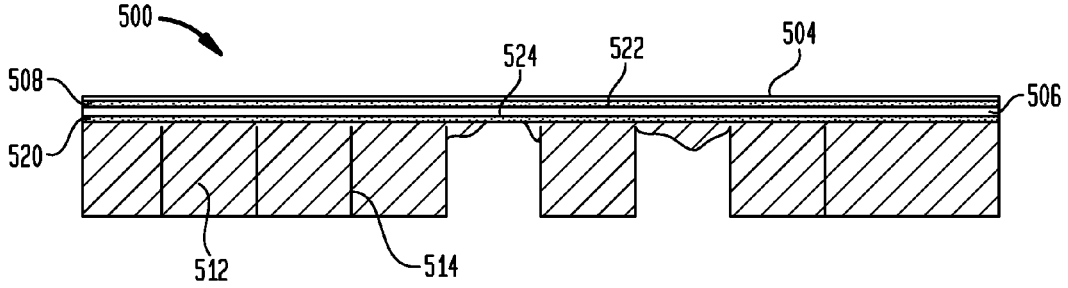
FIG. 5 is a cross-sectional view of the footwear insert depicted in FIG. 4 taken along lines 5-5 of FIG. 4 in accordance with an alternate embodiment of the present invention.

One such alternate is depicted in FIG. 5, which has a cross-section that is substantially identical to the cross-section of footwear insert 100 as depicted in FIG. 2 and as described herein, with the exception of first layer 106. As seen in FIG. 5, in lieu of first layer 106, footwear insert 500 includes a single-sided adhesive material, wherein the material 506 is fabric that has an adhesive 508 applied to the upwardly facing surface 522 thereof. The depicted embodiment also includes a removable backing 504 atop adhesive 508. Similar to first layer 106 of footwear insert 100 material 506 and its associated adhesive 508 and optional backing 504 are coupled to removable sections 512 via bond 520. Removable sections 512 are defined by cuts 514 similar to cuts 114 as described in greater detail herein.

In an embodiment similar to that shown in FIG. 5, a double-sided adhesive fabric could be substituted for the single-sided adhesive fabric. In such embodiments, bond 520 is not required as the adhesive applied to the downwardly facing surface 524 of the material 506 may be utilized to adhere removable sections 512 to material 506. In such embodiments, the removable sections may be able to be reattached to material 506 after initial removal thereof, but the integrity of bond 520 is likely to be significantly lesser than that described herein with respect to footwear insert 100. Each of these embodiments has its own advantages and disadvantages and the elements of the various footwear inserts may be interchanged in order to meet the specific needs of each user/product.

Referring back to FIG. 1, footwear insert 100 includes removable sections 112 across the entire downwardly facing surface of footwear insert 100 (i.e., there is no portion of the downwardly facing surface of footwear insert 100 that does not initially have a removable section 112 prior to customization by a user). In the depicted embodiment, the removable sections 112 are foam such as a memory-resistant polyurethane foam (e.g., PORON®). However, alternate materials and/or alternate types of foam may be substituted without departing from the scope hereof.

Also, removable sections 112 have an approximate thickness of five (5) mm, however, alternate thicknesses may be substituted without departing from the scope hereof. Similarly, removable sections 112 are shown as being approximately one-half (½) inch squares (or portions thereof at points at which the squares are cut by the exterior shape of the insert 100) arranged in a grid pattern, however, alternate shapes and alternate patterns may be substituted without departing from the scope of the present invention. For example, sections 112 may be substantially diamond, substantially rectangular, substantially triangular, substantially circular, and combinations thereof. Also, although the depicted embodiment includes sections 112 having nearly identical shapes and sizes, in some embodiments of the present invention, the shapes and/or sizes of the individual sections 112 in a specific insert may vary from the other shapes and/or sizes of the other sections 112 of the specific insert. Also, sections 112 do not need to be arranged in a pattern in order to meet the goals of the present invention. Also, in some embodiments of the present invention, some areas of the downwardly facing surface of footwear insert 100 do not have removable sections 112.

Footwear insert 100 includes a bond 110 that is a permanent bond. In some embodiments, these bonds are formed via a reactive polyurethane and polychloroprene solvent-based adhesive system, however, other types of bonds and/or other methods of creating the bonds may be substituted without departing from the scope hereof. Embodiments of the present invention are also envisioned that include non-permanent bonds.

In embodiments of the present invention that incorporate a permanent bond, the permanent bond facilitates the removal of one or more individual removable sections 112 without degrading the integrity of the bond between the first layer 106 and the surrounding removable sections 112 (i.e., the surrounding removable sections 112 are those sections 112 that are located adjacent one or more sections 112 that are/have been removed by the user). The use of a permanent bond allows the individual removable sections 112 to be removed by tearing the material of sections 112 without affecting the integrity of the bond between the first layer 106 and the surrounding removable sections 212. Although bond 110 is depicted in FIG. 2 as having a specific thickness, this thickness is not meant to illustrate an amount of bonding material to be utilized for bond 110. The amount of the bonding material may be varied without departing from the scope hereof.

As depicted in FIGS. 1 and 2, substantially vertical cuts 114 define individual removable sections 112 in order to facilitate the individual removal thereof without damage to the remainder of the footwear insert. In some embodiments of the present invention, removable sections 112 are removed by tearing the material of the removable section 112 in a location proximal to bond 110 but not necessarily at bond 110. Substantially vertical cuts 114 allow the piece to be removed when the tear intersects with all of the substantially vertical cuts 114 defining the removable section 112, thereby allowing the majority of the removable section 112 to be removed from the footwear insert. For example, in the embodiment depicted in FIGS. 1 and 2, removable sections 112 may be removed by tearing the material of removable section 112 along a tear line such as tear line 128 without damage to the remainder of the footwear insert because, in part, the amount of tear force required to tear the removable section 112 is significantly lower than the pull strength of bond 110 (bond 110 which binds the removable sections 112 and the surrounding removable sections 112 to first layer 106). Also, such removable section tear force is lower than the amount of force required to tear the material of first layer 106 These relative strengths facilitate removal of individual removable sections 112 without damage to first layer 106 or bond 110. This is particularly important for the portion of the bond 110 that secures surrounding removable sections 112 to the first layer 106 as it minimizes or eliminates the potential for surrounding removable sections 112 (i.e., removable sections located adjacent the cavity 132 caused by the removed sections 130) to unintentionally fall out, for example, due to wear and tear on the footwear insert caused by removal of the removed sections or use of the customized footwear insert. This bond 110 also helps to prevent surrounding removable sections 112 from "migrating" into cavity(ies) 132 while the user is wearing the insole, which can sometimes occur if the bond between the surrounding removable sections 112 and the first layer 106 is not strong enough to prevent such migration.

In some embodiments of the present invention, the footwear inserts are manufactured via a process with the following steps: 1) each of the layers is adhered to its adjacent layers, each layer having a size larger than the size of the footwear insert being created, and the layer of material that will become the removable sections is initially provided as a solid piece with no cuts therein; 2) the exterior shape of the footwear insert is cut through all of the adhered layers; 3) substantially vertical cuts 114 are cut into the solid layer of removable section material to create individual removable sections 112. In the embodiment of the present invention depicted in FIGS. 1 and 2, substantially vertical cuts 114 extend throughout ninety-nine (99) percent of the thickness of the removable section layer but do not penetrate the bond 110 or the first layer 106. However, alternate embodiments of the present invention are envisioned in which the substantially vertical cuts 114 extend through a lesser extent of the removable section layer of material and/or the cuts 114 penetrate bond 110 and/or first layer 106.

In some embodiments of the present invention in which the top layer is a microfiber type material, the footwear inserts are manufactured via a process with the following steps: 1) the microfiber is laid flat on a flat surface and prepped for bonding; 2) microfiber layer and foam or foam-type material layer is pretreated with a catalyst, microfiber is treated on the downwardly facing surface only whereas the foam is treated on both sides; 3) a catalytic-cured adhesive is applied to the pretreated side of the microfiber layer and to one side of the foam or foam-type material; 4) the adhesive is dried mechanically or otherwise; 5) the downwardly facing side of the microfiber layer is applied to the upwardly facing side of the foam or foam-type materials layer; 6) if additional layers of foam or foam-type materials are to be included, the additional layers are applied to each other, and to the foam or foam-type material layer coupled to the microfiber; 7) all layers are pressed together; 8) the exterior shape of the footwear insert is cut through all of the adhered layers; and 9) substantially vertical cuts are cut into the solid layer of removable section material to create individual removable sections to the extent desired.

The footwear inserts of the present invention may be utilized to create customized footwear inserts. To create these customized footwear inserts, the user simply removes the desired removable sections by tearing or the like. After all desired removable sections have been removed, the user inserts the footwear insert into the desired footwear. In some uses of the present invention, the user removes an original insole (i.e., the insole that is typically sold or otherwise provided with the footwear) from the footwear into which the insert will be inserted prior to inserting the footwear insert therein. Optionally, thereafter, the user may reinsert the original insole atop the upwardly facing surface of the customized footwear insert. However, reinsertion is not required as the user's foot may also rest comfortably upon the customized footwear insert.

In embodiments of the present invention that incorporate an adhesive backing on the upwardly facing surface of the footwear insert such as those shown in FIGS. 5 and 8, the adhesive backing may be removed from the footwear insert upwardly facing surface to expose the adhesive located below the backing. This step may be done prior to reinsertion of the original insole. Thereafter, the downwardly facing surface of the original insole may be adhered to said footwear insert upwardly facing surface via the adhesive.

Figure 3:
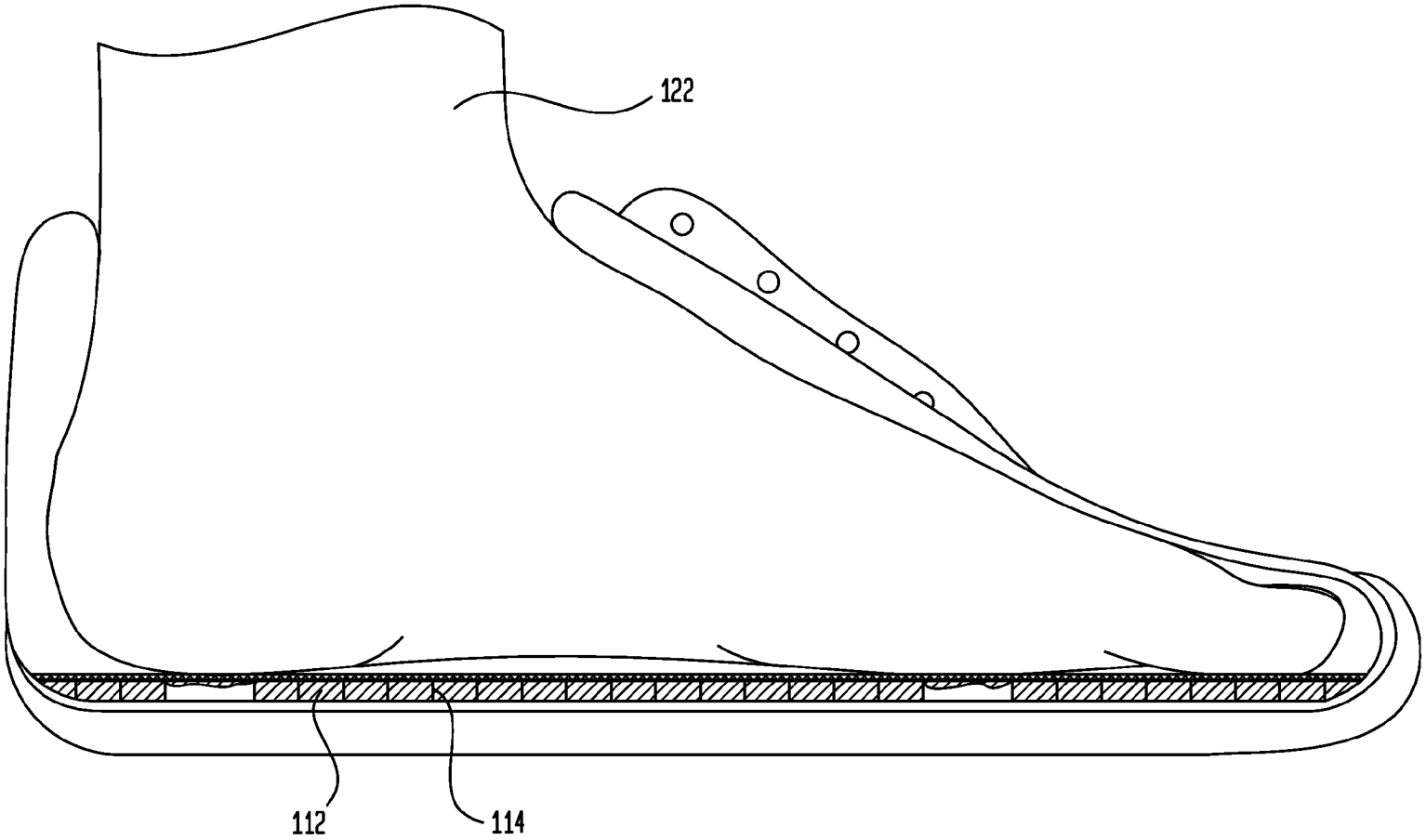
FIG. 3 is a cutaway view of the footwear insert of FIGS. 1 and 2 inserted into a shoe.

After the footwear insert has been customized by removing removable sections in locations that correspond with locations of the feet at which offloading is desired, the insert is then placed in footwear as is depicted in FIG. 3. When one is walking or standing while the insert is in his or her shoe, the areas of the foot 122 at which the removable sections have been removed will not contact the bottom surface inside the shoe or boot, and therefore will not transmit force to those locations of the foot. The forces involved with walking and standing will therefore be transmitted to the surrounding removable sections and other removable sections that have not been removed. In this manner, customization of the footwear insert via removal of specific removable sections creates one or more off-loading zone(s) to minimize the forces and pressure experienced by targeted areas of the feet during walking and standing.

Figure 7:
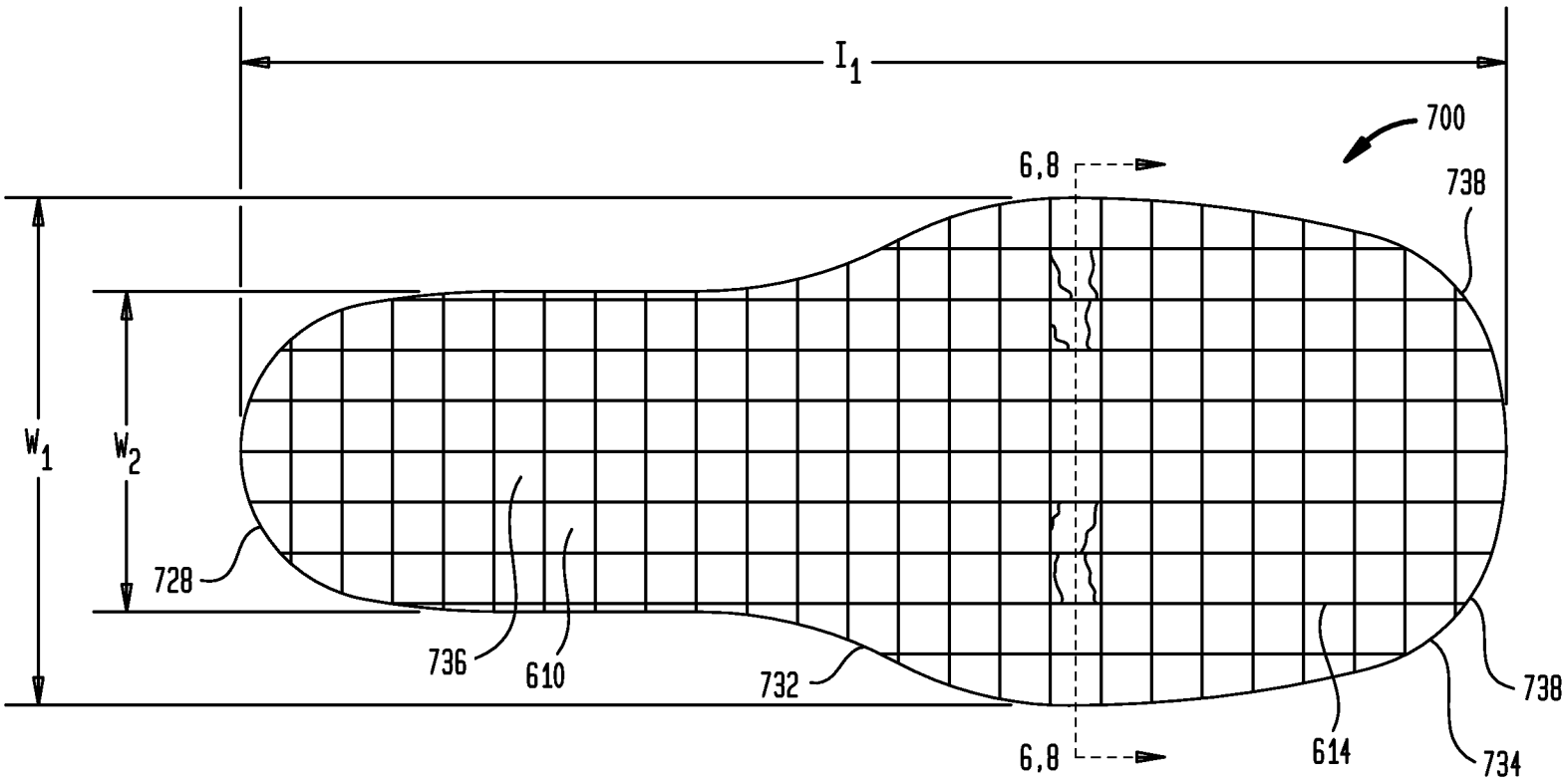
FIG. 7 a bottom view of a footwear insert shaped for custom sizing in accordance with one embodiment of the present invention.

Further embodiments of the present invention are envisioned in which the size and shape of the footwear insert is such that the footwear insert may be cut to a custom shape in order to fit any type of footwear. An example of one such insert shaped and sized for custom sizing is shown in FIG. 7. The overall size and shape of the insert 700 is larger than that of a typical insole, thereby allowing the user to cut the insert 700 as needed to fit the size of the footwear into Which it will be inserted. In the depicted embodiment, the insert has a length I1 of approximately 12.5 inches and widths W1 and W2 of approximately 4.75 and 3.25 inches, respectively, however, alternate dimensions may be substituted without departing from the scope hereof. The shape of insert 700 facilitates cutting of a custom size by the user by including a relatively standard heel section 736 having a substantially semicircular end 728 that will require minimal modification in order to meet the desired heel shape. Similarly, insert 700 includes relatively standard arch shapes 732 on both sides of insert 700 to allow the insert 700 to be easily modified to fit left or right footwear, again with relatively minor modification. Arch shapes 732 gradually enlarge as they extend from the heel section 736 of insert 700 to the enlarged toe section 734 of insert 700. Toe section 734 includes rounded edges 738 to facilitate fitting without cutting into a rounded toe section of footwear. Some or all of these sections of the insert 700 will be cut by the user as desired to create the exterior shape desired by the user.

Figure 4:
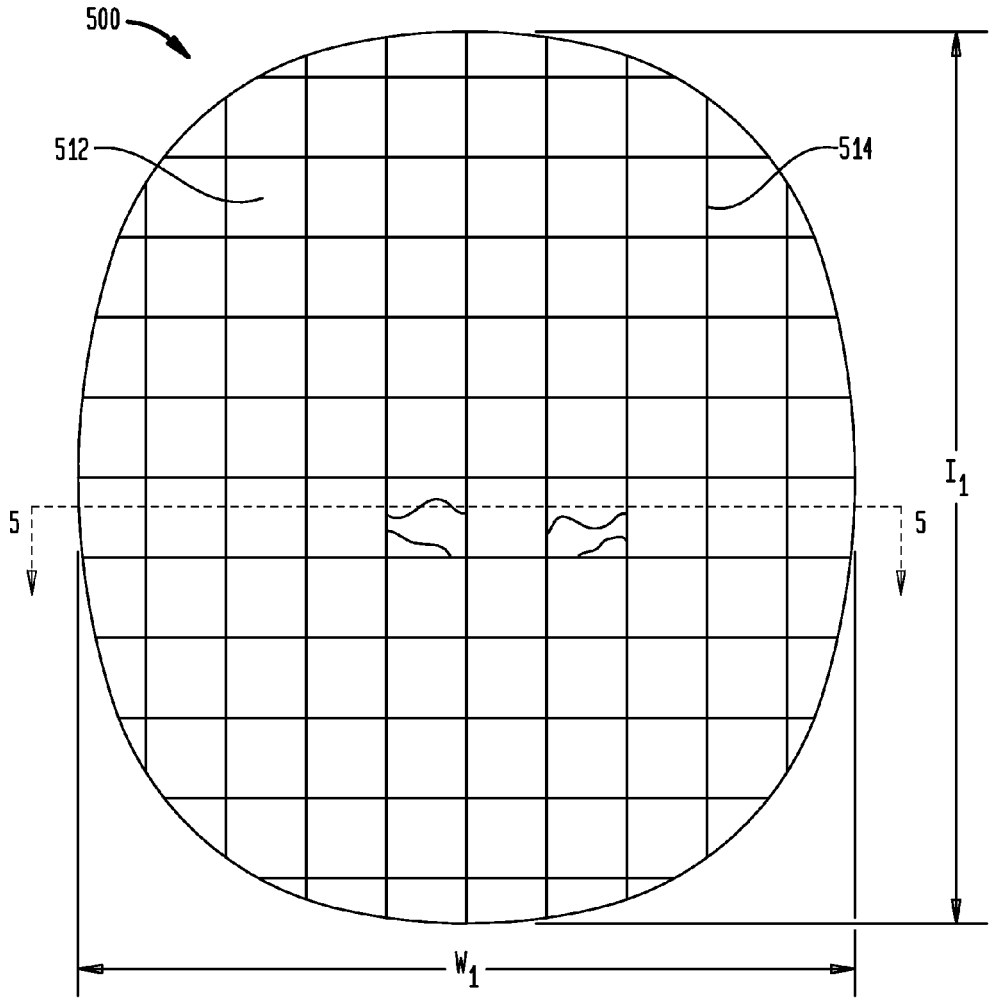
FIG. 4 is a bottom view of a substantially oblong footwear insert in accordance with one embodiment of the present invention.

Further embodiments of the present invention are envisioned in which the footwear insert is oblong such as the insert depicted in FIG. 4. Such a shape provides maximum coverage for use in any type of footwear. In the depicted embodiment, the insert has a length I1 of approximately 5.75 inches and a width W1 of approximately 4.75 inches, respectively, however, alternate dimensions may be substituted without departing from the scope hereof.

Figure 6:
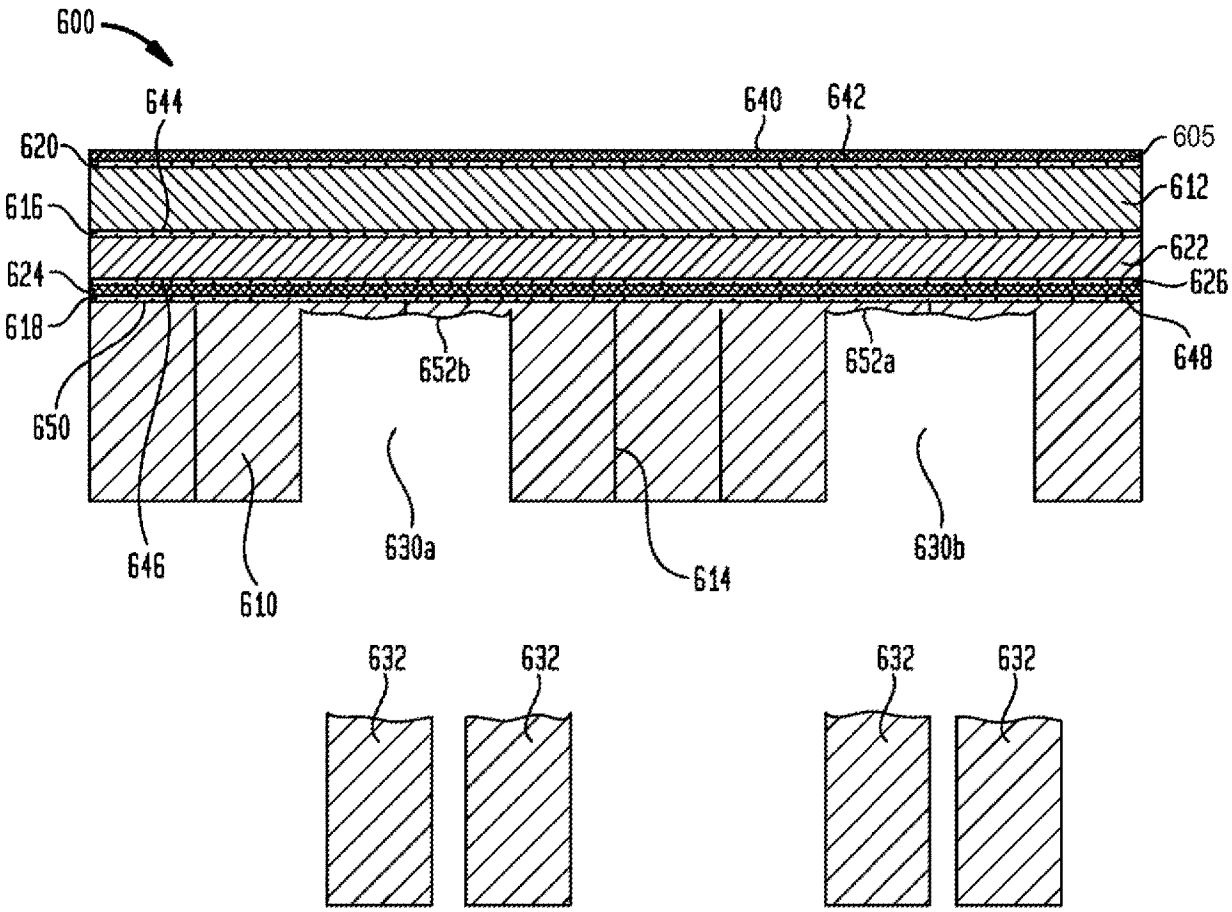
FIG. 6 is a cross-sectional view of the footwear insert depicted in FIG. 7 taken along lines 6,8-6,8 of FIG. 7 in accordance with one embodiment of the present invention.
Figure 8:
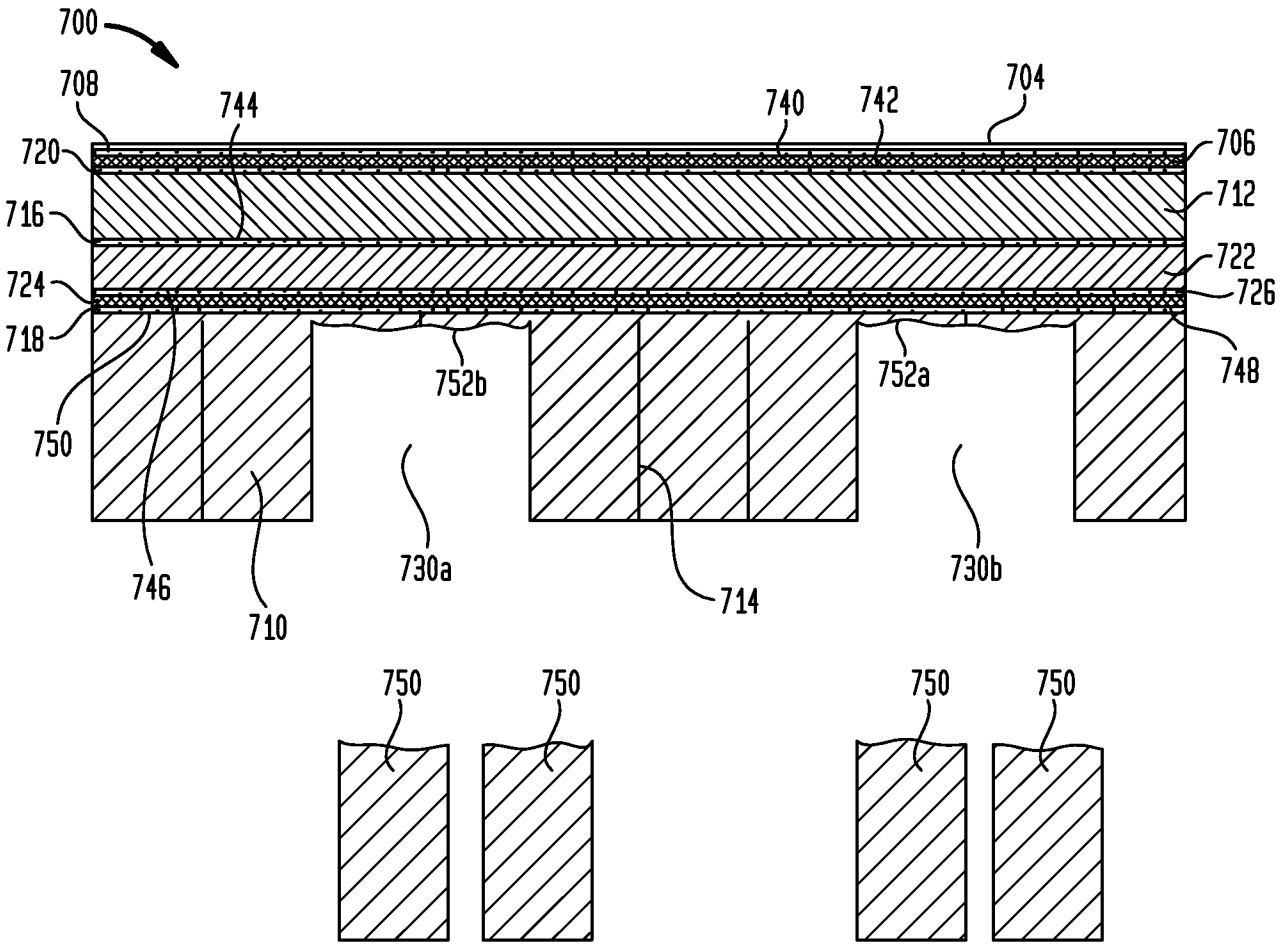
FIG. 8 is an alternate cross-sectional view of a footwear insert such as that depicted in FIG. 7 taken along lines 6,8-6,8 of FIG. 7 in accordance with one embodiment of the present invention.

Turning now to FIGS. 6 and 8, depicted are two potential cross-sections for the footwear insert 700 depicted in FIG. 7. However, it should be noted that the cross-sections of FIGS. 6 and 8 can be utilized with a footwear insert having virtually any external shape including, without limitation, those shapes shown in FIGS. 1 and 4 without departing from the scope hereof.

Referring now to the cross-sectional view of FIG. 6, insert 600 includes a first layer 605, a plurality of removable sections 610, a plurality of intermediate layers 612 and 622, and a material layer 624, wherein all of the layers are coupled to each other via a plurality of bonds 620, 616, 618, 626.

In the depicted embodiment, first layer 605 is similar to first layer 106 as described in greater detail herein. First layer 605 includes a first layer upwardly facing surface 640 (upon which objects may be placed such as a foot, an original insole, etc.) and a first layer downwardly facing surface 642. Downwardly facing surface 642 is coupled to the uppermost intermediate layer 612 via bond 620. In the depicted embodiment, bond 620, 616, 618, and 626 are as described herein for bond 110. However, bonds may be permanent or non-permanent without departing from the scope hereof. Also, bonds 620, 616, 618, and 626 may all be identical or may vary from each other without departing from the scope hereof.

In the depicted embodiment, uppermost intermediate layer 612 is a foam such as a memory-resistant polyurethane foam (e.g., PORON®) having an approximate thickness of three (3) mm. Intermediate layer 612 also has a different density than intermediate layer 622 and removable sections 610 in order to provide additional comfort and/or support to the user. For example, in the depicted embodiment, intermediate layer 612 is a PORON® Slow Rebound Material having model no. SRVFMA 15118 with antimicrobial properties. However, alternate non-foam materials and/or alternate types of foam may be substituted without departing from the scope hereof. Also, alternate thicknesses may be substituted without departing from the scope hereof.

Uppermost intermediate layer 612 has a downwardly facing surface 644, which is coupled to intermediate layer 622 via bond 616. In the depicted embodiment, intermediate layer 622 is a foam such as a memory-resistant polyurethane foam (e.g., PORON®) having an approximate thickness of two (2) mm. In the depicted embodiment, intermediate layer 622 is a PORON® Performance material having model no. FMA with antimicrobial properties. However, alternate non-foam materials and/or alternate types of foam may be substituted without departing from the scope hereof. Also, alternate thicknesses may be substituted without departing from the scope hereof.

Intermediate layer 622 has a downwardly facing surface 646, which is coupled to material layer 624 via bond 626. In the depicted embodiment, intermediate layer 622 is a fabric having an approximate thickness of one-half (0.5) mm. For example, the fabric may be a classic backing in mixed cotton having a weight of approximately 200 g/m$^2$. However, alternate non-fabric materials may be substituted without departing from the scope hereof. Also, alternate thicknesses may be substituted without departing from the scope hereof.

Material layer 624 has a downwardly facing surface 648, which is coupled to the upwardly facing surfaces 650 of the plurality of removable sections 610 via bond 618. In the depicted embodiment, removable sections 610 are defined by cuts 614 and extend across the entire downwardly facing surface of footwear insert 600 (i.e., there is no portion of the downwardly facing surface of footwear insert 600 that does not initially have a removable section 610 prior to customization by a user). In the depicted embodiment, the removable sections 610 are foam such as a memory-resistant polyurethane foam, for example, PORON® Performance material having model no. FMA with antimicrobial properties. However, alternate materials and/or alternate types of foam may be substituted without departing from the scope hereof.

Also, removable sections 610 have an approximate thickness of nine and one-half (9.5) mm, however, alternate thicknesses may be substituted without departing from the scope hereof. Similarly, removable sections 610 are shown (as best seen in FIG. 7) as being approximately one-half (½) inch squares (or portions thereof at points at which the squares are cut by the exterior shape of the insert 700 or the exterior shape thereof as customized by a user) arranged in a grid pattern, however, alternate shapes and sizes may be substituted without departing from the scope of the present invention as discussed in greater detail with reference to FIGS. 1 and 2.

In embodiments of the present invention that incorporate a permanent bond, the permanent bond facilitates the removal of one or more individual removable sections 610 without degrading the integrity of the bond between the material layer 624 and the surrounding removable sections 610 for the reasons discussed in greater detail herein with respect to first layer 106 and removable sections 112 of FIGS. 1 and 2. The material layer 624 further acts to prevent any damage to intermediate layers 612 and 622 during customization of the footwear insert 600 by the user (e.g., tearing of removable sections 610 from insert 600). That is, material layer 624 acts as a barrier that eliminates or minimizes tearing of intermediate layers 612 and/or 622 when pressure is applied to removable sections 610 during the tearing of same. In some embodiments of the present invention, removable sections 610 are removed by tearing the material of the removable section 610 in a location proximal to bond 618 but not necessarily at bond 618. Substantially vertical cuts 614 allow the piece to be removed when the tear intersects with all of the substantially vertical cuts 614 defining the removable section 610, thereby allowing the majority of the removable section 610 to be removed from the footwear insert. For example, in the embodiment depicted in FIGS. 6 and 7, removable sections 610 may be removed by tearing the material of removable section 610 along a tear line such as tear line 652 without damage to the remainder of the footwear insert because, in part, the amount of tear force required to tear the removable section 610 is significantly lower than the pull strength of bond 618 (bond 618 which binds the removable sections 610 and the surrounding removable sections 610 to material layer 624). Also, such removable section tear force is lower than the amount of force required to tear the material of material layer 624. These relative strengths facilitate removal of individual removable sections 610 without damage to material layer 624, bond 618, or any of the intermediate layers or bonds located above material layer 624. This is particularly important for the portion of the bond 618 that secures surrounding removable sections 610 to the material layer 624 as it minimizes or eliminates the potential for surrounding removable sections 610 (i.e., removable sections located adjacent the cavity 630 caused by the removed sections 632) to unintentionally fall out, for example, due to wear and tear on the footwear insert caused by removal of the removed sections or use of the customized footwear insert. This bond 618 also helps to prevent surrounding removable sections 610 from "migrating" into cavity(ies) 630 while the user is wearing the insole, which can sometimes occur if the bond between the surrounding removable sections 610 and the material layer 624 is not strong enough to prevent such migration.

It should be noted that the cross-section of FIG. 8 is substantially identical to the cross-section of FIG. 6 as described herein with the exception of first layer 605. As seen in FIG. 8, in lieu of first layer 605, footwear insert 700 includes a single-sided adhesive material, wherein the material 706 is fabric that has an adhesive 708 applied to the upwardly facing surface 740 thereof. The depicted embodiment also includes a removable backing 704 atop adhesive 708. Similar to first layer 605 of footwear insert 600, material 706 and its associated adhesive 708 and optional backing 704 are coupled to removable sections 710 via a plurality of bonds 720, 716, 718, 726 and intermediate layers 712, 722, and 724 which are substantially identical to bonds 620, 616, 618, 626 and intermediate layers 612, 622, and 624, respectively, as described herein. Removable sections 710 are defined by cuts 714 similar to cuts 114 as described in greater detail herein. Removable sections 710 may be removed by tearing the material of removable section 710 along a tear line such as tear line 752 as described in greater detail herein. The bond 718 that secures surrounding removable sections 710 to the material layer 724 minimizes or eliminates the potential for surrounding removable sections 710 (i.e., removable sections located adjacent the cavity 730 caused by the removed sections 750) to unintentionally fall out, for example, due to wear and tear on the footwear insert caused by removal of the removed sections or use of the customized footwear insert. This bond 718 also helps to prevent surrounding removable sections 710 from "migrating" into cavity(ies) 730 as described in greater detail herein.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A footwear insert comprising:

a fabric layer;

a first foam layer permanently bonded to an entirety of one surface of the fabric layer; and a second foam layer permanently bonded to an entirety of another surface of the fabric layer opposite the one surface, the fabric layer and the first and second foam layers being arranged to form an insole, the first foam layer having a plurality of cuts extending from a first portion on an outer surface of the first foam layer toward the fabric layer, through a majority of the first foam layer to a second portion in the first foam layer, and terminating prior to a third portion in the first foam layer, to define an array of a plurality of adjacent removable sections, each removable section being configured to be selectively permanently removed by tearing the first foam layer such that when torn, at least a part of the third portion of the first foam layer remains permanently bonded to the fabric layer, thus covering the fabric layer to form a customized insole to reduce plantar pressures on targeted areas of a foot.

2. The footwear insert of claim 1, wherein some of the plurality of removable sections define a perimeter of the insole.

3. The footwear insert of claim 1, wherein the first foam layer permanently bonded to the one surface of the fabric layer is permanently bonded by an adhesive.

4. The footwear insert of claim 1, wherein the removable sections have a square shape.

5. The footwear insert of claim 1, wherein the second foam layer includes one or more foam sublayers.

6. The footwear insert of claim 1, further comprising an additional layer, wherein the second foam layer is between the fabric layer and the additional layer.

7. The footwear insert of claim 6, wherein the additional layer is fabric.

8. The footwear insert of claim 6, wherein the additional layer is microfiber.

* * * * *